US005997268A

United States Patent [19]

Peach et al.

[11] Patent Number: 5,997,268

[45] Date of Patent: Dec. 7, 1999

[54] POSITIVE DISPLACEMENT HYDRAULIC MACHINE HAVING A RECESS RECEIVING A SPIGOT FOR SEALING

[75] Inventors: Richard Guy Peach; Barry Wynn, both of Dorset; Jeremy Arthur Sykes, Salisbury, all of United Kingdom

[73] Assignee: David Brown Hydraulics Limited, Dorset, United Kingdom

[21] Appl. No.: 08/913,852

[22] PCT Filed: Mar. 29, 1996

[86] PCT No.: PCT/GB96/00761

§ 371 Date: Dec. 5, 1997

§ 102(e) Date: Dec. 5, 1997

[87] PCT Pub. No.: WO96/31700

PCT Pub. Date: Oct. 10, 1996

[30] Foreign Application Priority Data

Apr. 1, 1995 [GB] United Kingdom ..... 9506827

[51] Int. Cl.[6] ..... F01C 1/18; F01C 19/00; F16L 21/00

[52] U.S. Cl. ..... 418/149; 418/206.6; 29/888.023; 285/917

[58] Field of Search ..... 418/149, 206.1, 418/206.6, 270; 285/334.4, 917; 29/525, 888.023

[56] References Cited

U.S. PATENT DOCUMENTS

| | | | |
|---|---|---|---|
| 2,460,957 | 2/1949 | Whitfield | 285/330 |
| 2,923,248 | 2/1960 | Hodgson | 418/132 |

FOREIGN PATENT DOCUMENTS

| | | | |
|---|---|---|---|
| 2343630 | 3/1975 | Germany | 418/206 |
| 2067667 | 7/1981 | United Kingdom . | |
| 2077358 | 12/1981 | United Kingdom . | |
| 2247923 | 3/1992 | United Kingdom . | |
| 9110045 | 7/1997 | WIPO | 418/201.1 |

*Primary Examiner*—John J. Vrablik

*Attorney, Agent, or Firm*—Nikaido, Marmelstein, Murray & Oram LLP

[57] ABSTRACT

A pressure fluid apparatus includes first and second parts which are adapted to be secured together. A first sealing surface of the first part forms a seal with a corresponding second sealing surface of the second part. The first sealing surface includes a spigot, and the second sealing surface includes a corresponding recess adapted to receive the spigot. The inside corner where the base of the spigot meets the first sealing surface is radiussed, and the outside corner where the mouth of the recess meets the second sealing surface is correspondingly truncated, so as to accommodate the radius. On either the radiussed inside corner or the truncated outside corner, an integral projection is provided which is deformable upon assembly of the parts, to block leakage of fluid along the path defined between the two corners.

7 Claims, 2 Drawing Sheets

Fig.1
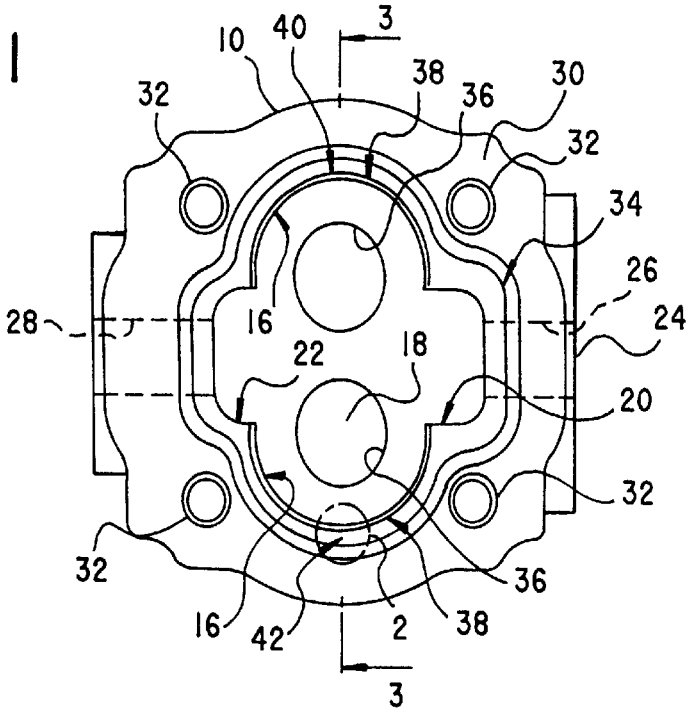
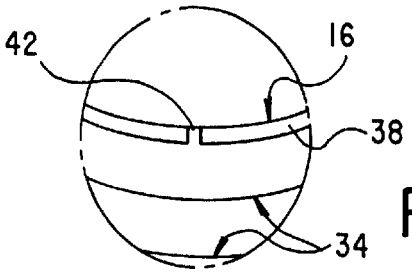
Fig.2
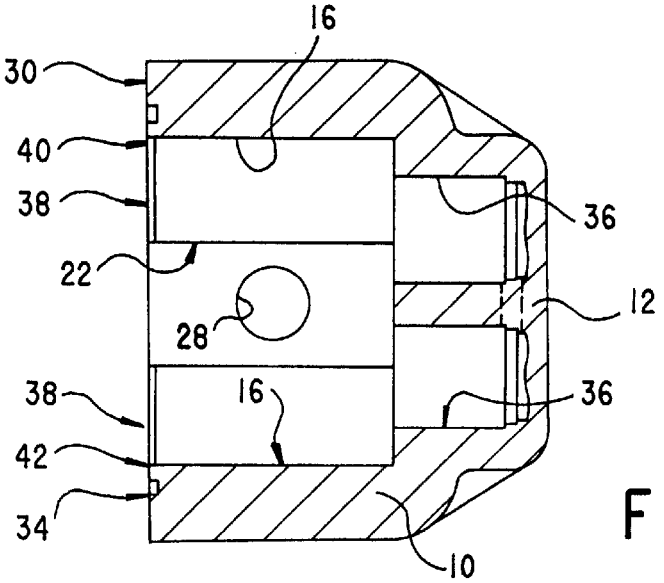
Fig.3

POSITIVE DISPLACEMENT HYDRAULIC MACHINE HAVING A RECESS RECEIVING A SPIGOT FOR SEALING

This invention relates to pressure fluid apparatus in general. Far example, it typically relates to positive displacement hydraulic machines of the kind comprising a gear pump or motor having a body in which there are formed overlapping bores within which two gears are disposed for rotation in mash with each other. The body is adapted to accommodate the gears with minimal radial clearance at the tips of their teeth and minimal axial clearance at their end faces. The body comprises a casing with two end covers in which there are mounted bearings for supporting two parallel shafts carrying the respective gears, at least one of the covers being separate from the casing to enable the machine to be assembled and being secured to the casing as by set-screws. One end of one of the shafts projects from the body and constitutes the power input in the case of a pump and the power output in the case of a motor.

Pressure fluid apparatus may have two component parts adapted to be located together by means of a spigot or the like formed on one of them. In order to manufacture this part it is necessary to provide radiussing in the corner between the spigot or the like and a flat face on which it is formed. It then becomes necessary to provide a truncation to the corresponding corner on the other part so as to accommodate the radiussing when the two parts are assembled together. However, this arrangement has the disadvantage that a path, along which pressure fluid can leak to a space at a lower pressure is defined between the radiussing and the truncated corner.

It is an object of the present invention to overcome the aforesaid disadvantage.

Accordingly, the invention comprises pressure fluid apparatus comprising first and second parts adapted to be secured together such that a first sealing surface of the first part forms a seal with a corresponding second sealing surface of the second part, the first sealing surface including a spigot and the second sealing surface including a corresponding recess adapted to receive the spigot, in which the inside corner where the base of the spigot meets the first sealing surface is radiussed and the outside corner where the mouth of the recess meet the second sealing surface is correspondingly truncated so as to accommodate the radius and in which there is provided on either the radiussed inside corner or the truncated outside corner an integral projection which is deformable on assembly together of the parts to block leakage of pressure fluid along the path defined between the two corners.

The pressure fluid apparatus may comprise a positive displacement hydraulic machine of the kind hereinbefore referred to.

Preferably, in such a machine, the or each separate end cover is accurately located on the casing by means of a non-circular spigot formed on the cover, the spigot fitting directly into the adjacent ends of the overlapping bores in the casing. Preferably the spigot makes an interference fit therein.

Preferably, also, the spigot has an end profile which comprises portions of two overlapping circles smoothly interconnected by arcs to form a waisted shape approximating to a figure of eight.

A projection as defined in the fourth paragraph hereof is preferably disposed along the line where the spigot fits in each of the overlapping bores.

A positive displacement hydraulic machine will have two such paths between the radiussing and the truncation extending from the high pressure side to the low pressure side, and such a machine preferably has two such projections, whereby both paths are interrupted.

Preferably the two projections lie in the plane containing the axis of both of the overlapping bores.

A preferred embodiment of the invention will now be described, by way of example only, with reference to the accompanying drawings of which:

FIG. 1 is an end elevation of the open end of a gear pump casing with one integral end cover;

FIG. 2 is an enlargement of the area circled at 2 in FIG. 1;

FIG. 3 is a section on the line 3—3 in FIG. 1:

Figure 5:
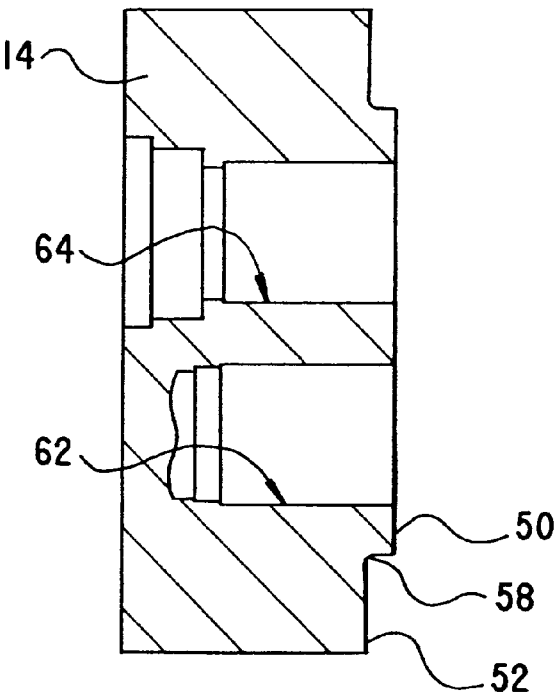
FIG. 5 is a section on the line 5—5 in FIG. 4.

Referring now to the drawings, a gear pump body comprises a casing 10 with an integral and cover 12 and a separate end cover 14. As shown in FIG. 1, overlapping parallel bores 16 formed in the casing 10 with their centre-lines in a plane 18 are intersected by parallel troughs 20 and 22 formed symmetrically about a plane 24 perpendicular to the plane 18, the trough 20 being deeper than the trough 22. An inlet port 26 having its centre-line in the plane 24 communicates with the trough 20, and an outlet port 28 likewise having its centre-line in that plane communicates with the trough 22.

The casing 10 has a flat end face 30 in which there are formed four tapped holes 32 and an asymmetrical groove 34. Parallel blind bores 36 which are not quite co-axial with the overlapping bores 16 are formed in the casing 10 for the purpose of accommodating bearings for one end of the shafts carrying the gears which are disposed, in use, in the bores 16. Chamfer means 38 are provided at the open ends of the overlapping bores 16 and are discontinuous at respective points on the bores (one of which points is best seen in FIG. 2), the discontinuities comprising circumferentially short (say 1 millimeter) integral projections 40 and 42.

Figure 4:
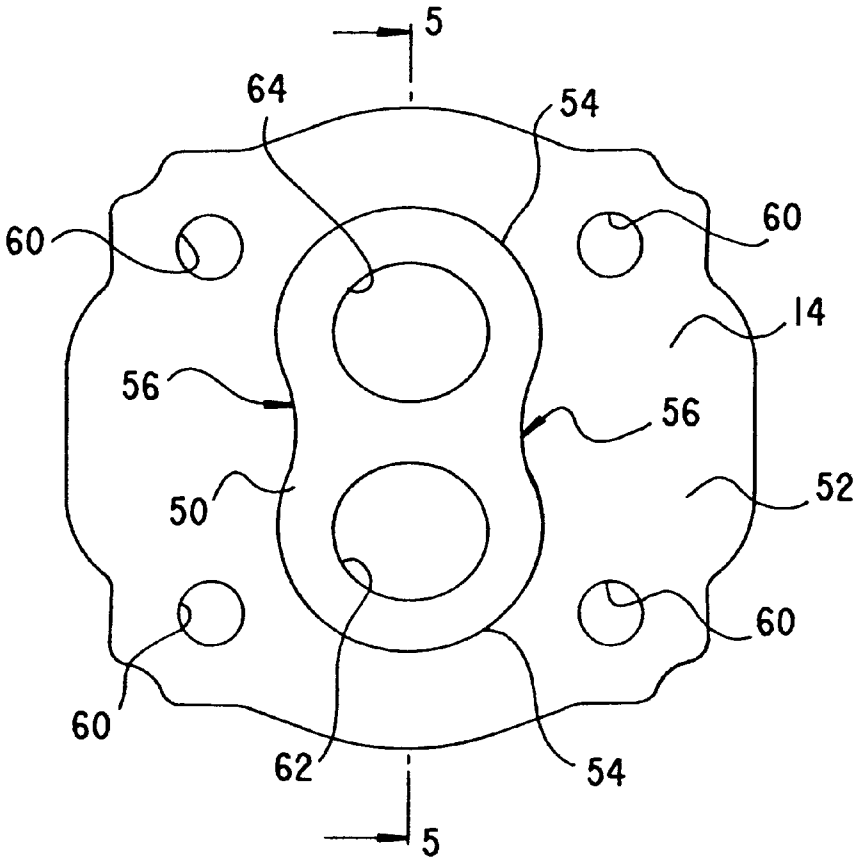
FIG. 4 is an end elevation of the inner face of a separate end cover for the casing.

As shown in FIG. 4, the separate end cover 14 has a non-circular spigot 50 formed on its inner end face 52, the and profile of the spigot comprising portions of two overlapping circles 54 smoothly interconnected by arcs 56 to form a waisted shape approximating to a figure of eight. These portions are a light interference fit of, say, 50 microns directly into the open ends of the overlapping bores 16 formed in the casing 10. Radius means 58 small enough to be accommodated within the space defined by the chamfer means 38 are provided between the inner end face 52 of the cover 14 and the spigot 50 formed thereon.

The cover 14 has formed in it four clearance holes 60 adapted to be aligned with the four tapped holes 32 formed in the casing 10. Parallel bores 62 and 64 which are adapted to be accurately aligned with the parallel bores 36 are formed in the cover 14 for the purpose of accommodating bearings for the other end of the shafts carrying the gears which are disposed in the overlapping bores 16. The bore 62 is blind but the bore 64 passes completely through the cover 14 to enable one end of the associated shaft to project from the gear pump body so as to constitute the power input, the bore 64 being adapted to house oil seal means.

The pump is assembled by mounting the bearings in the bores 36, 62 and 64 and the oil seal means in the bore 64, locating one end of the shafts in the bearings mounted in the bores 36, placing an o-ring in the groove 34, fitting the cover 14 over the other end of the shafts, and inserting four set-screws through the holes 60 into engagement with the holes 32. Tightening of the set-screws causes the spigot 50 to make a press fit into the adjacent ends of the overlapping bores 16, facilitated by the chamfer means 38, so that the bores 32, 62 and 64 are both accurately and firmly aligned. The o-ring in the groove 34 is compressed to seal the joint between the flat end face 30 of the casing 10 and the inner end face 52 of the cover 14; and the projections 40 and 42 are deformed so as to block the arcuate leakage paths from the outlet side to the inlet side of the pump which would otherwise exist between the chamfer means 38 and the radius means 58.

The end profile of the spigot 50 need not conform to the preferred shape described and illustrated herein but it must make an interference fit with the open ends of the overlapping bores 16 in the casing 10. The projections 40 and 42 can be provided on the radius means 58 instead of on the chamfer means 38. The invention is equally well applicable to a hydraulic gear motor as to a gear pump, and indeed to any kind of pressure fluid apparatus (including pneumatic apparatus) where the problem may occur.

We claim:

1. Pressure fluid apparatus comprising first and second parts adapted to be secured together such that a first sealing surface of the first part forms a sue with a corresponding second sealing surface of the second part, the first sealing surface including a spigot and the second sealing surface including a corresponding recess adapted to receive the spigot, in which the inside corner where the bass of the spigot meets the first sealing surface is radiussed and the outside corner where the mouth of the recess meets the second sealing surface is correspondingly truncated so as to accommodate the radius and in which there is provided on either the radiussed inside corner or the truncated outside corner an integral projection which is deformable on assembly together of the parts to block leakage of pressure fluid along the path defined between the two corners.

2. Apparatus according to claim 1 in which the spigot is adapted to make an interference fit in the recess.

3. Apparatus according to claim 1, consisting of a positive displacement hydraulic machine in which one of the two parts consists of an end cover which assembles together with the other part to form a gear pump or motor casing in which there are formed overlapping bores adapted to receive two gears for rotation in mesh with each other.

4. A machine according to claim 3 in which the end cover is the said first part, the overlapping bores in the casing form the said recess and the spigot is non-circular so as to fit directly into the overlapping bores.

5. A machine according to claim 4 in which the spigot has an end profile which comprises portions of two overlapping circles interconnected by arcs to form a waisted shape.

6. A machine according to any one of claims 3 to 5 in which two such projections are provided, each to interrupt a respective one of two such paths.

7. A machine according to claim 6 in which the two projections lie in the plane containing the axes of both of the overlapping bores.

* * * * *